US005554804A

United States Patent [19]

Delatorre et al.

[11] Patent Number: 5,554,804

[45] Date of Patent: Sep. 10, 1996

[54] HIGH TEMPERATURE PRESSURE MONITORING SYSTEM

[75] Inventors: Leroy C. Delatorre, Sugar Land, Tex.; René Pingenot, Springfield, Mo.

[73] Assignee: Panex Corporation, Sugar Land, Tex.

[21] Appl. No.: 406,516

[22] Filed: Mar. 20, 1995

[51] Int. Cl.[6] ..... G01V 1/00; F21B 47/06; G06F 15/20

[52] U.S. Cl. ..... 73/152.52; 340/853.1

[58] Field of Search ..... 73/151, 152; 340/853.1, 340/853.2, 853.3, 626, 854.3, 854.9, 854.1, 855.2, 854.4, 854.5

[56] References Cited

U.S. PATENT DOCUMENTS

| | | | |
|---|---|---|---|
| 4,012,712 | 3/1977 | Nelligan | 340/18 CM |
| 4,415,895 | 11/1983 | Flagg | 340/856 |
| 4,652,876 | 3/1987 | Darilek | 340/853 |
| 4,725,783 | 2/1988 | Miyairi et al. | 324/347 |
| 4,763,259 | 8/1988 | Delatorre et al. | 364/422 |
| 4,765,184 | 8/1988 | Delatorre et al. | 73/151 |
| 4,817,049 | 3/1989 | Bates et al. | 364/900 |
| 5,140,318 | 8/1992 | Stiner | 340/854.8 |
| 5,153,832 | 10/1992 | Anderson et al. | 364/422 |
| 5,350,018 | 9/1994 | Sorem et al. | 166/250 |
| 5,387,907 | 2/1995 | Gardner et al. | 340/854.9 |

*Primary Examiner*—Hezron E. Williams
*Assistant Examiner*—J. David Wiggins
*Attorney, Agent, or Firm*—Donald H. Fidler

[57] ABSTRACT

A pressure and temperature system for monitoring pressure and temperature conditions in a permanent installation in a high temperature production well traversing earth formations where the system in a pressure tool incorporates a programmable logic array device and a low density memory device. Each of a number of independent pressure tools is programmed to respond to a distinct digital polling signal for selecting a particular tool so that a single wire conductor can be used for data and control signal communication between the pressure tools placed downhole and a computer system situated at the earth surface. The system in a tool is powered up and down for each selected operation to conserve individual component useful life and the number of downhole components subject to high temperature is minimized.

11 Claims, 2 Drawing Sheets

PRIOR ART

HIGH TEMPERATURE PRESSURE MONITORING SYSTEM

FIELD OF THE INVENTION

This invention relates to pressure gauges for use in a well bore and more particularly to a system for monitoring one or more pressure gauges in a permanent installation in a high temperature production well.

BACKGROUND OF THE INVENTION

In a production well in a well bore, the amount of production from the well can be optimized if the downhole pressure at or near the producing formations is known. To obtain downhole pressure measurements in a production well, it has been heretofore a practice to dispose a production string of tubing in a well bore with an attached pressure gauge at the lower end of the production string of tubing. The pressure gauge has access to the bore of the production tubing for sensing pressure in the tubing and an exterior conductor cable couples the pressure sensing device to the earth's surface for a determination and monitoring of the pressure in the bore of the string of tubing. With the knowledge of pressure in the downhole string of tubing, the operator can optimize the flow of production and adjust the production rate to the downhole pressures for optimum production conditions.

In permanent installations where a pressure gauge is installed, the production of the well may occur over an extended period of time, which may be months into years before the production tubing is removed, if removed at all. Thus, it is necessary that a pressure gauge for use in a permanent installation have a long life and reliability because it is often times impractical and too expensive to remove a production string to replace a failed pressure gauge.

In deep well bores particularly, the downhole temperature increases as a function of depth and the temperatures typically are greater than 100° C. Temperatures above 100° C. introduce special problems for pressure gauges typically employed for measurement of downhole pressure. This is because a high temperature adversely affects the electronics in the components in a pressure gauge and will accelerate failure and wear out of the electrical components. Obviously, the likelihood of a system failure increases as a function of the number of electronic components in the tool as well as the ambient temperature.

In an effort to solve the problem of gauge failure, it has been proposed to use redundant downhole pressure systems. That is, two completely separate pressure gauge systems are used to increase the reliability factor. However, the use of redundant downhole pressure systems creates a degree of difficulty and expense of installing two separate cables to the earth's surface which can be prohibitive and in some cases impossible to obtain. Two pressure gauge systems could be connected to a single cable if the transmission of pressure measurements is alternated. With alternate transmission, only one pressure sensor gauge system would communicate at a time with the cable and there would be no interference from one pressure sensor gauge system to another. This approach, however, would require synchronization of the electronics in the pressure gauge system and require interconnection which limits the pressure gauge system to a common housing.

In the present invention the reliability of a downhole pressure system for high temperature wells is increased by reducing the number of electronic components which are exposed to the environment. Additionally, the present invention contemplates reducing power dissipation in the downhole tool to minimum since power dissipation in downhole components only increases the operating temperature above ambient and aggravates the temperature exposure problem of electronic components. Multiple independent pressure gauge systems can be used with a single wire cable.

SUMMARY OF THE PRESENT INVENTION

The present invention involves a system for monitoring the downhole pressure in a high temperature well bore over an extended period of time using multiple pressure sensing tools in the well bore which are respectively connected to a common single conductor cable. In the downhole well tool, the functions are kept to an absolute minimum and no microprocessor system is used. Instead a dedicated logic integrated circuit is employed with a line driver, a voltage discriminator, a crystal clock, an Eprom memory, and a power regulator which couple to a sensor system which develops a digital output signal representative of a pressure measurement.

In operation, a pressure measurement from one of a number of tools is obtained by transmitting a digital polling signal from the earth's surface which is unique to one of the pressure sensing tools to initiate operation of the sensing tool. The sensing tool is activated by the recognition of the polling signal and converts from a low power state to an operational state where it can transmit pressure measurements. The downhole system of the polled sensing tool utilizes low power programmed circuits to sample and transmit pressure measurements to the earth's surface.

DESCRIPTION OF THE INVENTION

Figure 1:
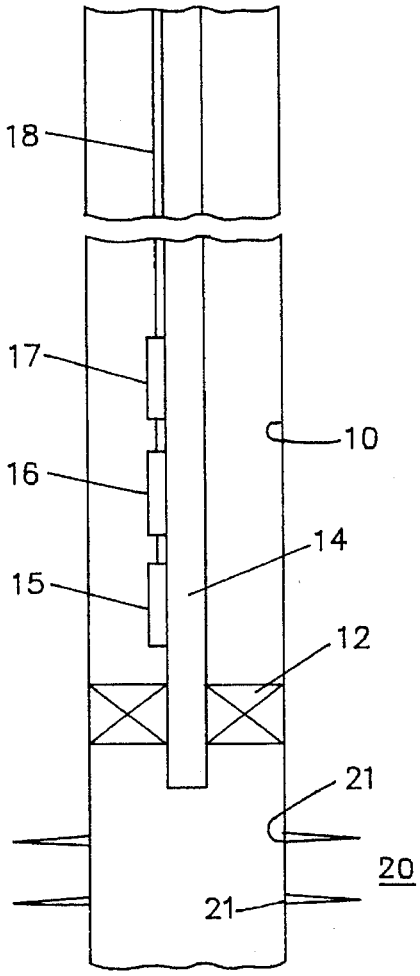
FIG. 1 is a schematic illustration of the environment for the present invention.

Referring now to FIG. 1, the present invention involves installation in a well bore 10 as illustrated where the well bore 10 traverses earth formations and is lined with a casing which is cemented in place. Disposed in the well bore 10 is a production packer 12 and a production tubing 14 which extends to the surface of the earth. Attached to the production tubing 14 are three pressure gauge sensing assemblies 15, 16, 17 which are respectively connected to a single wire cable 18 (sometimes called monocable) to the earth's surface and which have their pressure sensors open to the interior bore of the production tubing 14. A single wire cable is, of course, a single wire with a ground return which is commonly referred to as a single conductor cable. When the earth formations 20 produce fluids through the perforations 21 into the well bore 10, the fluids are transmitted via the production tubing 14 to the earth's surface. It is desired in the production of fluids to measure the downhole pressure of the produced fluids over a long period of time and under high temperatures.

Figures 3, 4, 5:
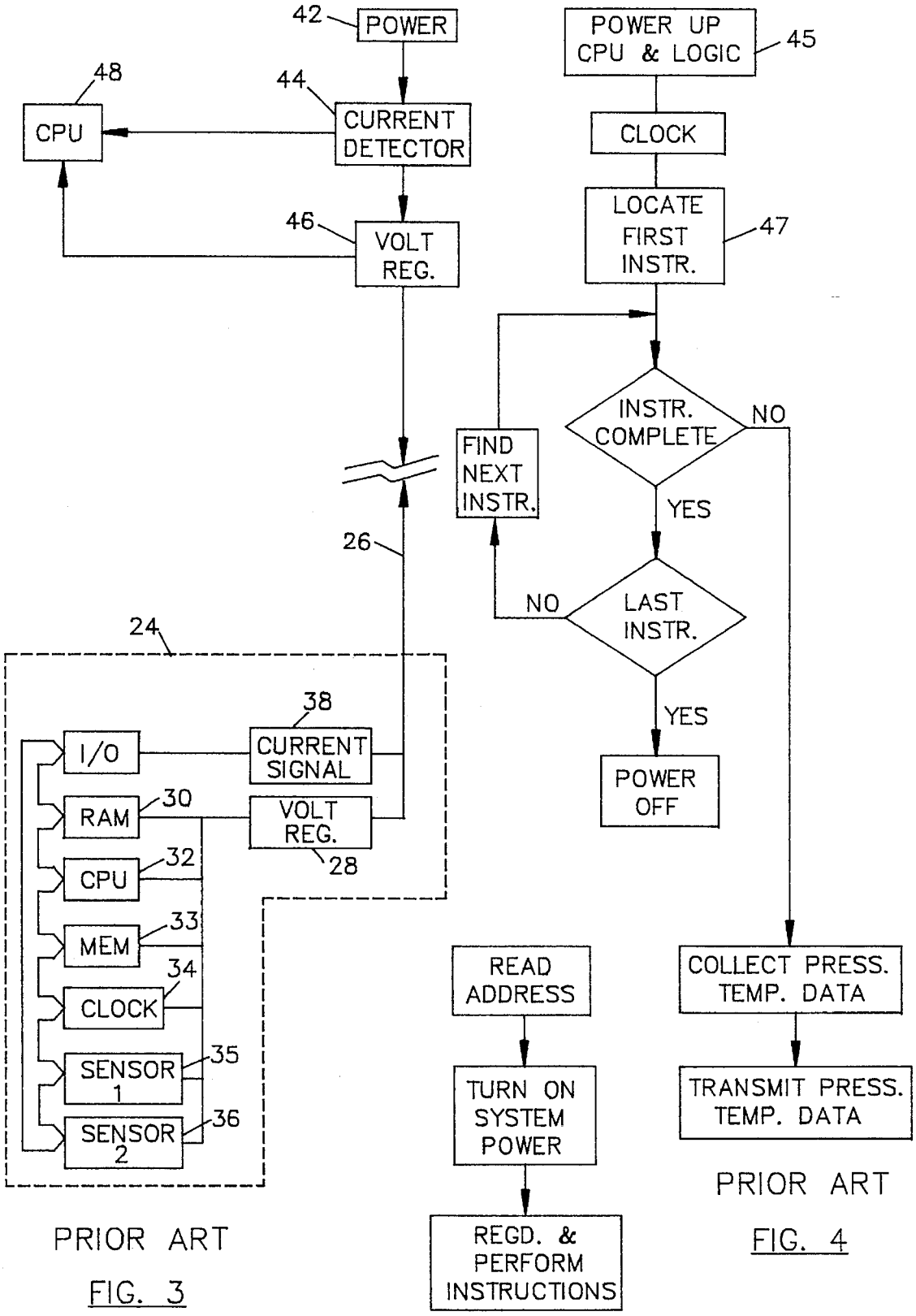
FIG. 3 PRIOR ART
FIG. 3 is a schematic illustration of a Prior Art configuration for permanent pressure gauge installations.
FIG. 4 is a flow chart of Prior Art operations for a permanent pressure gauge installation.
FIG. 5 is a flow chart of the operation for the present invention.

A prior art pressure gauge system for permanent well installations is illustrated schematically in FIG. 3. As shown in FIG. 3, a pressure gauge unit 24 is connected to a single wire conductor cable 26, with only one wire being shown. The pressure gauge unit 24 has a voltage regulator 28 which receives a D.C. power input from the two wipe cable conductor 26 and supplies power to the downhole pressure unit.

The downhole pressure unit 24 includes a RAM memory 30, a sensor unit CPU 32, a non-volatile memory 33, a clock 34, a sensor unit 35 for pressure and a sensor unit 36 for temperature. A voltage/current modulator system is utilized to transmit and receive data. In this system, the pressure and temperature measurements are digitized and transmitted according to programmed instructions in the CPU 32 to the earth's surface via a current signal generator 38.

With reference to FIG. 4, the CPU 32 in the downhole unit is preprogrammed prior to being installed in the well bore with instructions for obtaining pressure and temperature measurements usually for selected time periods. The downhole unit is attached to a production tubing in a well bore and connected by a cable to the earth's surface. After the system is installed in a well bore and a measurement is desired, a surface generated start up signal at the surface powers up the downhole CPU 32 and the instructions 45 are loaded into the CPU 32 (see FIG. 4). The clock 34 times the instructions to sample temperature and pressure measurements. When the first instruction 47 is located, the programming checks the recording instruction and operates the system to sample the pressure and temperature measurements in a sequence which are transmitted in digital form to the surface where the measurements are read out and recorded in a memory of the surface CPU 48. Further details and description of this type of transmission and components of the system are found in U.S. Pat. No. 4,763,259 issued Aug. 8, 1988 and in U.S. Ser. No. 08/020,393 filed Feb. 22, 1993.

When a system such as illustrated in FIG. 3 is employed in permanent well installations for high temperature wells above 100° C., the higher ambient temperature accelerates failure of the system.

Reliability in a permanent installation type of well application is a very important consideration since it can be prohibitively expensive to recover a failed gauge. In the past, this has tended to make permanent gauge installations increasingly impractical as operating ambient temperatures went above 100° C.

One way that reliability can be increased for a high temperature application is to reduce the electrical component count exposed to this environment. This means that, in the case of the permanent gauge, the system complexity should be concentrated in functions performed at the earth's surface as opposed to downhole.

Another important factor for enhancing reliability in a high ambient temperature environment is to keep power dissipation in the downhole unit to a minimum. Obviously, any power dissipation in the downhole components will only increase their operating temperature above the ambient and aggregate the temperature exposure problem.

Also, if two completely redundant systems can be used the reliability is increased by a factor of four, assuming there are no common wearout or failure mechanisms. This is the same principle that applies to reducing the number of components in each system. This is the direct result of the increased likelihood of installing a component with an undetected failure mechanism as the number of system components increases.

However, use of redundant downhole gauge systems is complicated due to the degree of difficulty and expense of installing two separate cables to the surface which can be prohibitive. It is desirable to have two independent systems which have the capability to be powered and to communicate with a common cable. The systems should also be such that a failure in one does not result in disabling the other.

The most direct method of having two pressure gauges share the same cable for communication is to alternate their transmissions. Since only one gauge would be communicating with the cable at a time then there can be no crosstalk or interference from one gauge to another. The direct approach for doing this, however, requires synchronization of the gauge electronics and interconnection. This limits or requires the gauges to be within the same housing.

The approach of polling the gauges from the surface for selective retrieval of the downhole data is a more universal solution. This would allow each gauge to be independently connected to the cable and also would provide the added versatility of allowing each gauge to be used for a redundant or separate physical measurement. The drawback to this approach, however, is that conventional techniques for achieving this result involve relatively complex, power hungry downhole systems. This occurs because a microprocessor system is required which is complex and therefore also requires more power.

It would seem that recent, single-chip microprocessors would also meet the above requirements. To some extent this is true (the component count will still likely be higher) but there is also another serious limitation that enters the picture. All microprocessors must rely on a high density program memory to perform their function and experience has shown that these memory systems are not reliable at high temperature.

Some background on memory for high temperature applications may be in order. Random access memory (RAM) normally operates well under elevated temperature conditions since this memory is simply composed of transistors arranged to hold an entered logic state. Of course, this type of memory will not hold its information if power is removed and therefore is unsuitable as a program memory.

Another type of memory that is suitable to be a program memory is Eprom or EEprom. Both of these will hold their information with the removal of power but both can give problems at high temperature. These memory types rely on a stored electrical charge as a means of storing information and high temperature aggravates conditions which can cause this to be lost.

A type of memory that can be reliable at high temperature and which is also suitable as a program memory is the mask programmable type. The big disadvantage to this type of memory is that it is very expensive unless large volumes of memory devices are involved. This is because the custom pattern must be installed at the chip level and therefore it is not economical for small runs.

In the present invention it is possible to achieve the low power, low electrical component count goals, however, by keeping the downhole system functions to an absolute minimum and by not using a microprocessor system. In a present invention, all functions are performed by dedicated logic elements and the component count is minimized by the use of a programmable logic device.

Even though the programmable logic device requires a memory for configuration, this memory is read only once on start up. This is in contrast to a CPU where an instruction must be read from the program memory prior to each operation. Also, a much smaller memory is required for the programmable logic device than for a CPU and the high temperature performance capability of an EPROM type memory drops as the density increases.

A programmable logic device is ideal with simple functions and it is practical with low density one time programmable Eproms (since power is only applied to the memory during start up) but fusible link memories can be used. Fusible link memory is practical because the required memory capacity is low.

Figure 2:
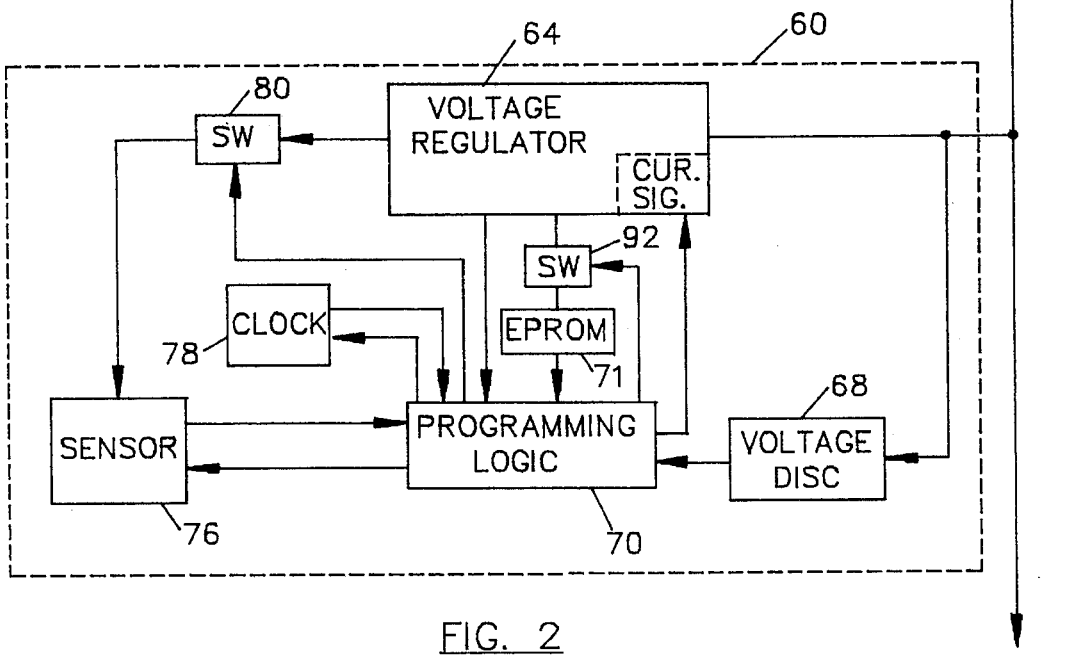
FIG. 2 is a schematic illustration of the configuration of the present invention.

Referring now to FIG. 2, a pressure gauge unit 60, which is structurally identical to another pressure gauge unit 85 shown above it, is connected to a single wire conductor cable 62 where D.C. power is applied to a voltage regulator 64 in the unit 60. The conductor cable 62 also connects to a voltage discriminator 68 which can receive and input digital bits in a voltage format to a programmable logic device 70. The logic device 70 is configured by a serial EPROM 71 at start up time. The EPROM 71 is operated at the start up by applied power through an on/off switch 72 which also disconnects power from the EPROM 71 after the logic device 70 is configured by the EPROM 71. The temperature and pressure sensors 76 (and switching circuits) as well as a clock 78 are connected to the logic device 70 and include electronics to produce frequency signals as a function of pressure and a function of temperature. The electronics for the sensors 76 are activated by a switch 80 where the switch 80 is controlled by the logic device.

The programmable logic device 70 is also sometimes referred to as a programmable gate array. This device is available from XILINX which is located at San Jose, Calif. In particular, a XILINX array XC3042A is suitable and this device provides a group of high density, high performance, digitally integrated circuits. In the array, the user logic functions and interconnections are stored in internal static memory cells. The EPROM 71, such as a XILINX chip XC1736, provides a permanent storage of a configuration program for the array and is a low density memory chip. The EPROM 71 is activated when power is applied and provides an automatic loading of the configuration program to the logic device 70 for providing digital data representative of pressure and temperature from the sensors. When the configuration program is loaded into the logic device 70, the EPROM 71 is turned off by an instruction to the switch 92 from the logic device 70. Switch 92 is reset when power is first applied from the regulator 64.

A significant advantage of the logic device 70 over a CPU is that the logic device 70 reads the configuration program in the non-volatile memory (EPROM) 71 only once on start up and then operates in a low power state until activated by an address signal. In contrast, a CPU requires a high density memory which is read for each program step. Thus, the memory 71 can be a low density type which is more reliable at high temperatures than a high density memory. Moreover, the read-write cycles in a high density memory required with a CPU reduces the life of a memory device.

In operation, the pressure gauge unit 60 is in an idle, low power mode and a power switch 80 to the sensors 76 removes power from the electronics for the sensors. The clock 78 is controlled as to its on and off state by the logic device 70. The logic device 70 is in a low level state of operation until it is activated by a unique digital address. When a unique digital bit stream containing the address is transmitted from the earth's surface via the cable 62 it is received and recognized or not recognized by the logic device 70. If the address is recognized, the logic device 70 connects up power to the various shut down circuits. The digital bit stream containing the address is generated by the surface unit which has a CPU 77, a power source 79, a current sensor 81 for detecting a current signal from downhole and a voltage regulator 82 controlled by the CPU 77 for communicating with the downhole unit with a bit signal. A unique digital address as dictated by the CPU 77 is transmitted by voltage regulator 82 in digital bit form to the downhole voltage discriminator 68. The voltage discriminator 68 provides the digital bit stream containing the address to the programmable logic device 70. If the address is for the pressure gauge unit 60, the programmable logic device 70 recognizes the address and actuates the switch 80 which turns on the electronics for the sensors 76 and the clock 78 is started by the logic device 70. The digital address is followed by digital bit instructions which dictate the number of readings or measurements to be sent back. The number of measurements to be sent back is controlled by digital bit instructions to the programmable logic device 70 from the CPU 77 at the earth's surface.

In the idle mode of the gauge downhole, much of the electronics is powered down by use of the switch 80 and the switch 92 which prolongs the high temperature life of the electronics. The logic device 70 is configured to receive program bit instructions from the CPU at the earth's surface so that the pressure measurements are output by current signal modulation means in the voltage regulator 64 to the cable conductor 62 according to the bit instructions. The current modulation does not affect the power regulation to the system. Other pressure and temperature gauges such as gauge 85 are connected in parallel on the same downhole cable conductor.

All addressing and sequencing of the device 70 is under software control of the CPU 77 at the surface. The power-down feature is used when gauges are not required to transmit data often or sequence at a high speed, which is normally the case. This feature not only extends the life of a powered down component, but also greatly reduces the power required by multiple gauges on a common line.

The number of readings from each gauge is totally flexible and easily changed at the surface. Any gauge can be addressed to digitally transmit one or more readings and this can be followed by any other gauge or no readings for a period.

All readings from the current modulation means and addresses to the voltage discriminator 68 are transmitted and received as a string of tones which have no D.C. component and can be A.C. coupled. For example, with a 600 $H_z$ signal, by changing the cycles per bit, digital signals are created, i.e., a "011" address could be one cycle at 600 $H_z$, two cycles at 1200 $H_z$ and two cycles at 600 $H_z$. The change in frequency is used to distinguish between two adjacent bits. This allows transmission over the long downhole cable and capacitor coupling to the electronics with no problem. Transmission from the gauges is accomplished by current modulation of the current drawn by the unit. Address transmission to the downhole gauges is accomplished by voltage modulation of the line voltage supplied at the surface.

It will be apparent to those skilled in the art that various changes may be made in the invention without departing from the spirit and scope thereof and therefore the invention is not limited by that which is disclosed in the drawings and specifications but only as indicated in the appended claims.

We claim:

1. A system for monitoring downhole pressure in a high temperature well bore over an extended period of time where there are multiple pressure sensing tools in the well bore which are connected to a common single wire conductor cable disposed within said well bore and leading to the earth's surface and for selectively reading out pressure measurements from the respective pressure sensing tools, which system is comprised of:

a production string of pipe disposed in a high temperature well bore;

more than one pressure sensing tool disposed downhole on the string of pipe where each pressure sensing tool is connected to the single wire conductor cable which extends along the string of pipe to the earth's surface;

each of said pressure sensing tools having sensor means for obtaining pressure measurements in digital format, downhole communication means for receiving and sending digital signals on said single wire conductor cable, programmable means for storing a specified operational configuration for processing digital signals of the pressure sensor means in digital format, programmable logic means connected to said pressure sensor means and said downhole communication means, said logic means in each of said pressure sensing tools respectively being configured and arranged to respond to a selected characterized digital polling signal from the earth's surface to output pressure measurements from a selected sensor tool to said conductor cable for transmission of digital signals up to the earth's surface;

surface communication means at the earth's surface connected to said conductor cable for selectively generating different characterized digital polling signals on the conductor cable so that a characterized digital polling signal can be used by said logic means for selectively actuating one of said pressure sensing tools to obtain pressure measurements from the one pressure sensing tool independently of any or all of the other sensing tools.

2. The system as set forth in claim 1 wherein said downhole communication means includes current modulating means for sending digital signals from a pressure sensing tool and including voltage discriminator means for receiving said digital polling signals from the surface communication means at the earth's surface.

3. The system as set forth in claim 1 and further including in a pressure sensing tool: a power source means for supplying power to the sensor means and switch means connecting said pressure sensor means to said means for supplying power to the sensor means when the programmable memory means are actuated and a power source means for removing power and providing an idle mode of sensor means function when the communication process of said sending and receiving digital signals is discontinued.

4. The system as set forth in claim 2 wherein the power means includes a voltage regulator disposed downhole within the pressure sensing tool for supplying power to said downhole communication means and said sensor means;

switch means disposed downhole within the pressure sensing tool for selectively connecting said power source means to said sensor means between an actuating mode and an idle mode; and wherein said surface communication means develops addressing polling and control signals in a digital format.

5. A system for monitoring downhole pressure in a high temperature well bore over an extended period of time where there are multiple pressure sensing tools in the well bore which are connected to a common single wire conductor cable to the earth's surface and for selectively reading out pressure measurements from the respective pressure sensing tools, which system is comprised of:

a production string of pipe disposed in a high temperature well bore;

more than one pressure sensing tool disposed on the string of pipe where each pressure sensing tool is connected to the single wire conductor cable which extends along the string of pipe to the earth's surface;

each of said pressure sensing tools having sensor means for obtaining pressure measurements in digital format, downhole communication means for receiving and sending digital signals on said single wire conductor cable, non-volatile memory means for storing a specified operational configuration for a programmable logic means, power source means for providing electrical power to the sensor means, non-volatile memory means and programmable logic means, programmable logic means connected to said pressure sensor means, said memory means, said downhole communication means, and said power source means, said logic means in each of said pressure sensing tools respectively being configured by said memory means upon operation of said power source means so that output pressure measurements from a selected sensor tool can be electrically communicated to said conductor cable, said logic means when configured being arranged to respond to a selected characterized digital polling signal from the earth's surface;

first switch means connecting said power source means to said pressure sensor means, said first switch means being responsive to said logic means for actuating said sensor means; and surface communication means at the earth's surface connected to said conductor cable for selectively generating different characterized digital polling signals on the conductor cable so that a characterized digital polling signal corresponding to a selected logic address means of a particular pressure sensing tool can be used for selectively actuating the selected pressure sensing tool to obtain pressure measurements from the selected pressure sensing tool independently of the other pressure sensing tools.

6. The system as set forth in claim 5 wherein said downhole communication means includes current modulating means for sending digital signals from a pressure sensing tool and including voltage discriminator means for receiving digital signals from the surface communication means at the earth's surface.

7. The system as set forth in claim 5 and further including in a pressure sensing tool, second switch means connected to said power source means for powering up said memory means for configuring said programmable logic means when power is applied.

8. The system as set forth in claim 7 wherein a program with the programmable logic configuration means provided by automatic loading from a low density type of memory chip.

9. A method for determining downhole pressure periodically during long time spans wherein a production string of tubing is disposed in a high temperature well bore and has a more than one pressure sensing tool commonly coupled by a single conductor cable to a CPU control means at the earth's surface, and wherein a pressure sensing tool has sensor means which responds to pressure to develop digital signals representative of sensed pressure, said method comprising the steps of:

selecting the pressure sensing tool in the well bore to actuate;

transmitting a unique digital address and actuation signal for a given pressure sensing tool from the CPU control means at the earth's surface to the pressure tools in the well bore to actuate only the selected pressure sensing tool which responds to the unique digital actuating signal to actuate the sensor means of the given pressure sensing tool to develop pressure measurements in a digital format;

transmitting instructions from the earth's surface in a digital format for the given pressure sensing tool to transmit a number of pressure measurements to the CPU control means at the earth's surface; and transmitting pressure measurements from the given pressure sensing tool to the CPU control means at the earth's surface.

10. The method as set forth in claim 9 wherein said selected pressure sensing tool has a programmable logic device and a configuration memory means electrically connected thereto and applying power to said configuration memory means and configuring the programmable logic device for coupling said pressure measurements to said conductor cable, and thereafter upon configuring the logic device to function for turning off the configuration memory means.

11. The method as set forth in claim 10 wherein the programmable logic device further performs a step of actuating the sensor means.

* * * * *